United States Patent [19]

Ataka et al.

[11] 4,405,879

[45] Sep. 20, 1983

[54] PHOTOELECTRIC CONVERSION DEVICE AND METHOD OF PRODUCING THE SAME

[75] Inventors: Saburo Ataka, Tokyo; Yoshinori Imamura, Hachioji; Yasuo Tanaka, Kokubunji; Hirokazu Matsubara, Hamuramachi; Eiichi Maruyama, Kodaira, all of Japan

[73] Assignee: Hitachi, Ltd., Tokyo, Japan

[21] Appl. No.: 246,588

[22] Filed: Mar. 23, 1981

[30] Foreign Application Priority Data

Mar. 24, 1980 [JP] Japan ..... 55-36071

[51] Int. Cl.[3] ..... H01J 29/45; H01J 31/38; B05D 1/36

[52] U.S. Cl. ..... 313/386; 427/76

[58] Field of Search ..... 313/386; 427/76

[56] References Cited

U.S. PATENT DOCUMENTS 3,890,525 6/1975 Hirai et al. ..... 313/386
3,947,717 3/1976 Busanovich et al. ..... 313/386
4,255,686 3/1981 Maruyama et al. ..... 313/386 X
4,307,319 12/1981 Terao et al. ..... 313/386

FOREIGN PATENT DOCUMENTS 53-42610 11/1978 Japan ..... 313/386

*Primary Examiner*—Palmer C. Demeo
*Attorney, Agent, or Firm*—Antonelli, Terry & Wands

[57] ABSTRACT

There is disclosed a photoelectric conversion device comprising a transparent substrate; a transparent conductive film formed on said substrate; a photoconductive layer formed of hydrogenated amorphous silicon as an indispensable component and deposited on said transparent conductive film; and a chalcogen glass film formed on said photoconductive layer, wherein said chalcogen glass film includes at least a chalcogen glass layer formed in an atmosphere of inert gas kept at $1.5\times10^{-2}$ to $1.5\times10^{-1}$ Torr. As chalcogen glass is preferably used $Sb_2S_3$, $As_2S_3$, $As_2Se_3$ or $Sb_2Se_3$. The chalcogen glass film may be a composite film consisting of plural component layers. This invention is very useful to reduce dark current in an image pickup tube and to prevent image inversion in the image pickup tube.

12 Claims, 5 Drawing Figures

PHOTOELECTRIC CONVERSION DEVICE AND METHOD OF PRODUCING THE SAME

This invention relates to a photoelectric conversion device applicable to, for example, the target of a photoconductive image pickup tube operated in storage mode and a method of fabricating the same.

A typical example of photoelectric conversion devices operated in storage mode is a photoconductive image pickup tube. In this type of device, a transparent conductive film and a photoconductive layer are provided as a target on a transparent substrate ordinarily called a faceplate, and the target is sealed in an envelope, which includes therein an electron gun at its end opposite to the photoconductive layer. An image sent through the faceplate is converted to electric signals by means of the photoconductive layer and the photo-carries generated by light are stored on the surface of the photoconductive layer. The thus stored pattern of electric charges is time-sequentially read as electric signals by electron beam scanning.

Usually, a beam landing layer is provided on the surface of the photoconductive layer. The beam landing layer is used to prevent the image inversion of the charge pattern ascribed to the secondary electrons produced through the bombardment of the photoconductive layer by the electron beams. In general, chalcogen such as, for example, $Sb_2S_3$ is used as material for the beam landing layer.

There is a prior art in which hydrogenated amorphous silicon is used as the photoconductive material of the above mentioned photoelectric conversion device. That is the Japanese Patent Laid-Open (Kokai) No. 150995/79.

The main object of this invention is to provide a photoelectric conversion device in which dark current is small and image inversion never occurs.

The gist of this invention is the provision of chalcogen glass layer on the photoconductive layer formed of hydrogenated amorphous silicon as an indispensable component the chalcogen glass layer being formed in an atomsphere of inert gas kept at $1.5\times10^{-2}$ Torr–$1.5\times10^{-1}$ Torr. When the chalcogen glass layer is formed, the substrate is kept at a temperature of 20°–200° C.

This invention is particularly effective where the photoconductive layer is of N conductivity type. Antimony trisulfide ($Sb_2S_3$), diarsenic trisulfide ($As_2S_3$), antimony triselenide ($Sb_2Se_3$) or diarsenic selenide ($As_2Se_3$) is preferably used as chalcogen glass. The thickness of the chalcogen glass layer formed under the conditions described above is controlled to 30–400 nm.

A composite chalcogen glass layer consisting of plural layers may be formed on the photoconductive layer. In that case, at least one of the plural layers has only to be chalcogen glass layer formed under the above-described conditions. A typical example is a double layer chalcogen glass film composed of a first chalcogen glass layer formed in an atmosphere of inert gas kept at a pressure below $10^{-2}$ Torr and a second chalcogen glass layer formed in an atmosphere containing inert gas at a pressure of $1.5\times10^{-2}$–$1.5\times10^{-1}$ Torr. The order of lamination of the first and the second chalcogen glass layer is exchangeable. A composite layer consisting of more than two component layers may also be employed. Alternatively, the condition of forming the chalcogen glass layers may be continuously changed. In this case, however, at least the portion of the continuous layer having a thickness of at least 30 nm must be formed with inert gas kept at $1.5\times10^{-2}$ Torr–$1.5\times10^{-1}$ Torr. In the formation of a composite layer, it is more preferable for the achievement of desired purposes to form the lower layer (i.e. on the side of the substrate) in an atmosphere containing a lower pressure and the upper layer (i.e. on the side facing the electron gun) in an atmosphere containing a higher pressure. By doing this, a high yield can be attained. Even in the case where a composite layer is used, the thickness of the chalcogen glass should be controlled to not more than 1000 nm. Argon and nitrogen are used as inert gas.

Moreover, the photoconductive film consists of the single layer or a composite layer. The single layer or at least one layer of the composite layer is formed of amorphous material containing silicon of more than 50 atomic percent and hydrogen of 5 to 50 atomic percent and having a resistivity of higher than $10^{10}$ Ω·cm. Further, in the above photoconductive film, 0.1 to 50 atomic percent of the silicon may be replaced by germanium. In this specification, the materials having all the compositions mentioned above are referred to simply as amorphous silicon. The thickness of the photoconductive film is usually chosen to be 100 nm to 20 μm.

The above and other objects as well as the features of the invention will become more apparent from the following description taken in conjunction with the accompanying drawings in which:

FIG. 1 schematically shows in cross section a photoelectric conversion device as an embodiment of this invention;

FIG. 2 schematically shows an image pickup tube;

Figure 1:
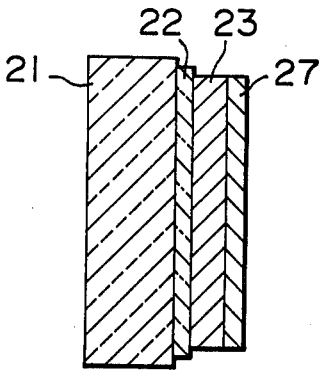

FIG. 1 schematically shows in cross section a photoelectric conversion device as an embodiment of this invention. A transparent electrode 22 of tin oxide ($SnO_2$) having a thickness of 100–200 nm is deposited by, for example, chemical vapor deposition (CVD) method on a glass faceplate having a diameter of ⅝ inch. Usually, translucent metal film, indium oxide film or tin oxide film is used as the transparent electrode. An a-Si:H (amorphous silicon containing hydrogen) film 23 having a thickness of 1–5 μm and a high resistivity is formed on the transparent electrode 22 by using a reactive sputtering of silicon in hydrogen atmosphere. The sputtering conditions for the formation of the above film 23 are such that the discharge power is 300 W (with substrate kept at 200° to 250° C.), the partial pressure of argon is $3\times10^{-3}$ Torr, and the partial pressure of hydrogen is $2\times10^{-3}$ Torr. Namely, the partial pressure ratio of hydrogen is 0.4. In this case, the content of hydrogen in the film is about 15 atomic percent. The a-Si:H film thus formed can assume as high a resistivity a $10^{12}$–$10^{13}$ Ω·cm. This a-Si:H film exhibited a slight conductivity of N-type. A chalcogen glass film 27 of antimony trisulfide ($Sb_2S_3$) is formed on the a-Si:H film 23 to a thickness of 30–400 nm by vapor deposition method in an atmosphere of argon gas. The vacuum vapor deposition of the chalcogen glass film 27 was performed as follows. Namely, the atmosphere within the bell jar of the vacuum vapor deposition apparatus was drawn out to establish a high degree of vacuum of $10^{-6}$–$10^{-5}$ Torr and then argon gas was introduced into the bell jar to assume a relatively low degree of vacuum with the partial pressure of argon of $1.5\times10^{-2}$ Torr, and the evaporation source was heated for vapor deposition in this atmosphere. The substrate (faceplate) 21 was kept at room temperatures. The temperature of the substrate can be raised up to 200° C. Alternatively, an electron beam evaporation method may be used. In the conventional method of the formation of chalcogen glass, the temperature of the substrate was kept as low as possible to prevent the degradation of vacuum in the evaporating vessel. On the contrary, according to this invention, the temperature of the substrate need not be kept low since the formation of films are performed in an atmosphere of low vacuum. The resultant film is therefore different from that formed in an atmosphere of high vacuum, having porosity due to the bombardment of argon atoms with chalcogen molecules. The porous film has a low rate of secondary electron emission due to its porosity. Moreover, the electron trap takes place more easily in this porous film. This can be ascertained by the measurement of the signal current $I_{sig}$ and the dark current $I_d$ from an image pickup tube using this type of porous film. The target constructed in the above-described manner is incorporated in the image pickup tube.

Figure 2:
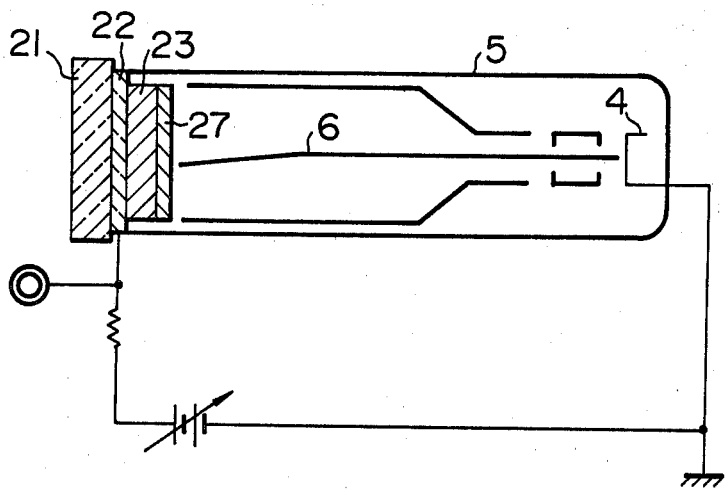

FIG. 2 shows a photoconductive type image pickup tube used in storage mode. This photoconductive image pickup tube comprises a transparent substrate 21 called faceplate, a transparent conductive film (electrode) 22, a photoconductive layer 23, a beam landing layer 27, an electron gun and an envelope 5. A blocking layer may be formed between the transparent conductive film 22 and the photoconductive film 23, if necessary. This example also falls into the scope of this invention. As the blocking layer is used an N-type oxide such as cerium oxide or silicon dioxide.

Figure 3:
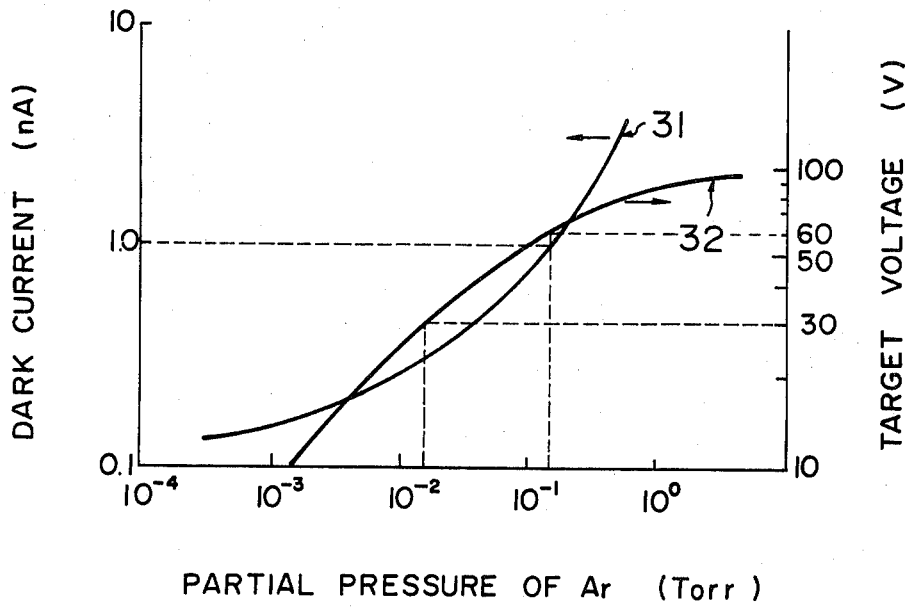
FIG. 3 shows the relationships between the pressure of Ar gas and the dark current and between the pressure of Ar gas and the target voltage for image inversion, the Ar gas pressure being assumed in the process of forming the chalcogen glass.

FIG. 3 shows the characteristic of image pickup tubes using chalcogen glass targets formed by the method described above with the condition of forming the chalcogen glass varied. The abscissa indicates the partial pressure of Ar gas. Curve 31 shows the dependence of the dark current upon the partial pressure of Ar gas. In this case the target voltage is 50 V. As apparent from FIG. 3, the dark current can be rendered small if the chalcogen glass used is formed in a range of Ar partial pressure below $1.5\times10^{-1}$ Torr. In practical application, the dark current $I_d$ must be less than 1.0 nA. For this value of the dark current $I_d$, the signal current $I_{sig}$ must be greater than about 500 nA since the ratio $I_{sig}/I_d$ must be greater than 500. If the chalcogen glass used is formed in range of rather high degree of vacuum, the resultant layer has a comparatively dense structure so that the electrons of the scanning beam do not penetrate the layer. This prevents a cause of the increase in dark current.

The beam landing layer, which is irradiated by the electron beam, generates secondary electrons. If the quantity of the secondary electrons is too great, an image inversion takes place. The secondary electron emission from the beam landing layer can be reduced by forming the chalcogen glass layer in a range of higher Ar partial pressure. For this reason, the partial pressure of the Ar gas in the atmosphere used in the formation of the chalcogen glass must be higher than $1.5\times10^{-2}$ Torr. Curve 32 in FIG. 3 represents the relation between the target voltage at which image inversion occurs and the condition for the production of the chalcogen glass. It is usually difficult to directly measure the rate of secondary electron emission and therefore the rate is expressed in terms of the target voltage. An atmosphere having the Ar partial pressure of higher than $1.5\times10^{-2}$ Torr satisfies the conditions practically required for the target voltage. Namely, the target voltage must be higher than 30 V for a practicable photoelectric conversion device using amorphous silicon. When the chalcogen glass film used was formed in an inert gas atmosphere of $1.5\times10^{-1}$ Torr, the target voltage at which image inversion occurs was higher than 60 V. The target voltage should be controlled to less than 100 V since too high a target voltage may cause a breakdown leading to white flaws.

The observation by an SEM (scanning electron microscope) and the measurement of light transmissivity can recognize the difference between the chalcogen glass film formed in the gas atmosphere of $1.5\times10^{-2}$–$1.5\times10^{-1}$ Torr and the ordinary vacuum-formed film (i.e. dense film formed in high vacuum higher than $10^{-2}$ Torr). The chalcogen glass film formed of $Sb_2S_3$ in a gas atmosphere of $1.5\times10^{-2}$–$1.5\times10^{-1}$ Torr evidently has a light transmissivity higher by more than 10% and also a resistivity higher by an order, than those of the vacuum-formed film, for its porosity. The abovesaid chalcogen film is of P-type conductivity, like an ordinary beam landing film.

The beam landing film according to this invention will particularly exhibit an outstanding effect where the photoconductive layer is of N-type conductivity. Since electrons can move swiftly in the N-type semiconductor, externally injected electrons (e.g. scanning electrons from the electron gun) tend to form noise, i.e. dark current. This is why the effect of this invention is remarkable.

Figure 4:
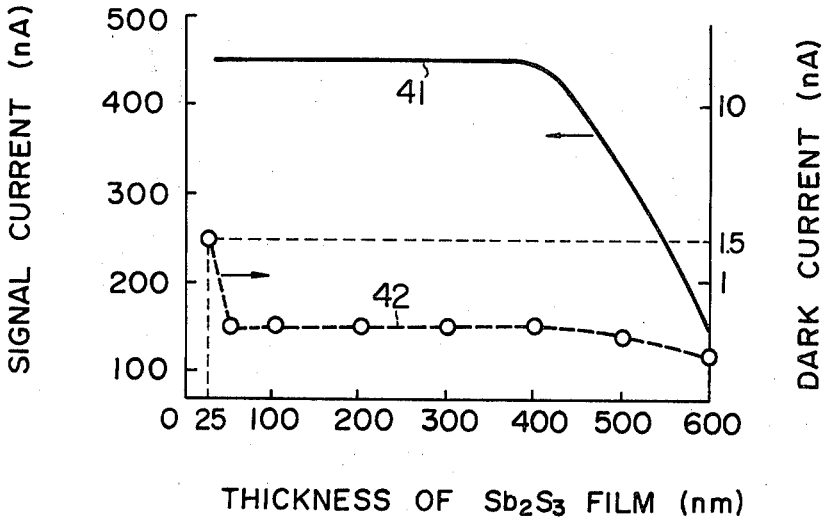
FIG. 4 shows the relationship between the thickness of the $Sb_2S_3$ layer and the image pickup characteristics.

FIG. 4 shows the relationships of the thickness of the beam landing layer of $Sb_2S_3$ to the signal current (curve 41) and to the dark current (curve 42). Here, the target voltage is 50 V. The Ar partial pressure in the vapor-deposition of a $Sb_2S_3$ film is set at $6\times10^{-2}$ Torr. The dark current is 1.5 nA while the signal current is 450 nA, when the $Sb_2S_3$ film has a thickness of 25 nm. In the case where the thickness is less than 25 nm, the dark current is very large due to the penetration or the tunnel effect of electrons so that too thin a layer is unsuitable. Then, the signal current $I_{sig}$ was as high as 450 nA while the dark current $I_d$ was 0.5 nA, when the thickness of the $Sb_2S_3$ film was 30–400 nm. The ratio $I_{sig}/I_d$ was 900 so that very clear pictures could be obtained. On the other hand, when the thickness of the $Sb_2S_3$ film was 400–600 nm, the signal current falls steeply.

As described above, the beam landing film of chalcogen glass controls the mobility of carriers and if its thickness is greater than a certain value, the signal current as well as the dark current is attenuated. On the contrary, if the thickness is too small, the dark current increases to cause an anomalous phenomenon to degrade reproduced pictures. This invention is very effective not only where a single-layer chalcogen glass film is used but also where a multi-layered or composite chalcogen glass film is used.

Figure 5:
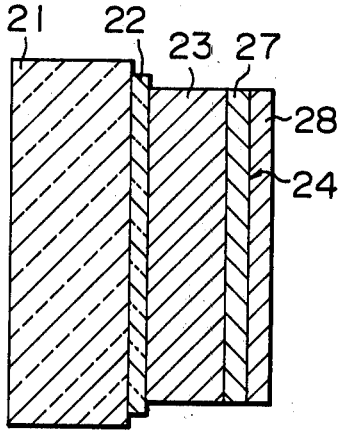
FIG. 5 schematically shows in cross section a photoelectric conversion device as another embodiment of this invention.

FIG. 5 schematically shows a photoelectric conversion device as another embodiment of this invention.

In FIG. 5, the chalcogen glass film corresponding to that shown in FIG. 1 consists of two layers. The first layer is a film 27 of $Sb_2S_3$ having a thickness of 90 nm, formed in vacuum of $10^{-5}$ Torr. The second layer is a film 28 of $Sb_2S_3$ formed by vapor-deposition in an atmosphere of nitrogen gas kept at $6\times10^{-2}$ Torr. The other parts are the same as those indicated by the corresponding reference numerals in FIG. 1, and the description thereof is omitted. With this double-layer chalcogen glass film which has an interface 24, the trap of electrons from the scanning beam was more effective.

In the above described composite film, the chalcogen glass formed in an atmosphere of $1.5\times10^{-2}$–$1.5\times10^{-1}$ Torr was used on the side exposed to the electron beam, but even when it was disposed on the side nearer to the photoconductive layer, good pictures could be obtained. Also, the same good characteristic could be obtained even in the case where a chalcogen glass film consisting of more that two layers was used, if such chalcogen glass as formed in an atmosphere of $1.5\times10^{-2}$–$1.5\times10^{-1}$ Torr was provided on the a-Si:H film.

TABLE I

| Ar partial pressure | | Ar partial pressure 2nd layer (100 nm) $10^{-2}$ Torr | $1.5\times10^{-2}$ | $6\times10^{-2}$ | $1.5\times10^{-1}$ |
|---|---|---|---|---|---|
| 1st layer (100 nm) | $10^{-6}$ Torr | image inversion | 0.70 | 0.80 | 0.95 |
| | $10^{-5}$ | image inversion | 0.65 | 0.80 | 0.95 |
| | $3\times10^{-5}$ | image inversion | 0.65 | 0.75 | 0.95 |
| | $3\times10^{-4}$ | image inversion | 0.60 | 0.75 | 0.90 |
| | $10^{-3}$ | image inversion | 0.60 | 0.70 | 0.85 |
| | $10^{-2}$ | image inversion | 0.60 | 0.70 | 0.80 |

Dark Current (nA)

The table I given above lists the values of dark currents flowing in the double-layer chalcogen glass films in each of which the second layer of $Sb_2S_3$ having a thickness of 100 nm was formed on the first layer of $Sb_2S_3$ having a thickness of 100 nm, with the respective Ar partial pressures as tabulated. When the first layer was formed under $10^{-6}$–$10^{-2}$ Torr while the second layer was formed under $10^{-2}$ Torr, then image inversion took place so that no good picture could be obtained. However, when the second layer was formed under $1.5\times10^{-2}$–$1.5\times10^{-1}$ Torr, the corresponding dark current was less than 1 nA and good pictures could be obtained. In this case, the used image pickup tube was a $\frac{2}{3}$ inch type with the target voltage $V_T=50$ V.

TABLE II

| Film thickness | | Film thickness 2nd layer ($6\times10^{-2}$ Torr) 30 nm | 50 | 100 | 200 | 400 |
|---|---|---|---|---|---|---|
| 1st layer ($10^{-5}$ Torr) | 30 nm | 0.5 | 0.5 | 0.5 | 0.5 | 0.4 |
| | 50 | 0.5 | 0.5 | 0.5 | 0.5 | 0.4 |
| | 100 | 0.5 | 0.5 | 0.5 | 0.4 | 0.3 |
| | 200 | 0.5 | 0.5 | 0.4 | 0.4 | 0.3 |
| | 400 | 0.4 | 0.4 | 0.4 | 0.3 | 0.2 |

Dark Current (nA)

The table II given above lists the values of dark currents flowing in the double-layer chalcogen glass films in each of which the second layer of $Sb_2S_3$ formed under $6\times10^{-2}$ Torr was deposited on the first layer of $Sb_2S_3$ formed under $10^{-5}$ Torr, with the respective thicknesses as tabulated. When the first layer as the beam landing film was 30–400 nm thick while the second layer was 30–400 nm thick, the dark current was not more than 0.5 nA and good pictures could be obtained. The ratio of the thickness of the first layer to the thickness of the second layer need not be set at any definite value. However, as described above, when the thickness of the chalcogen glass exceeds a certain value, the signal current decreases. Accordingly, it is necessary for the whole chalcogen glass film to have a thickness of not more than 1 μm and for each of the component layer to have a thickness in a range of 30–400 nm. The conditions for measurement was the same as in the previous case.

TABLE III

| Material | | Material 2nd layer ($6\times10^{-2}$ Torr, 100 nm) $Sb_2S_3$ | $As_2Se_3$ | $As_2S_3$ | $Sb_2Se_3$ |
|---|---|---|---|---|---|
| 1st layer ($10^{-5}$ Torr, 100 nm) | $Sb_2S_3$ | 0.80 | 0.75 | 0.95 | 0.90 |
| | $As_2S_3$ | 0.85 | 0.80 | 0.95 | 0.95 |
| | $As_2Se_3$ | 0.90 | 0.85 | 5 | 7 |

Dark Current (nA)

The table III given above lists the values of the dark currents flowing in the chalcogen glass films in each of which the second layer formed with a thickness of 100 nm under $6\times10^{-2}$ Torr was provided on the first layer formed with a thickness of 100 nm under $10^{-5}$ Torr, with the materials for the respective layers varied as tabulated. Here, the target voltage was 50 V. When the first layer was formed of $Sb_2S_3$ or $As_2S_3$, the second layer was formed of $Sb_2S_3$, $As_2S_3$, $As_2Se_3$ $Sb_2Se_3$. Accordingly, the dark current was less than 1 nA so that good pictures could be obtained. Even when the first layer is formed of $As_2Se_3$ or $Sb_2Se_3$, the dark current can be less than 1 nA with the target voltage kept lower than 50 V.

What is claimed is:

1. A photoelectric conversion device comprising a transparent substrate;

a transparent conductive film formed on said substrate;

a photoconductive layer made of amorphous silicon formed on said transparent conductive film; and a chalcogen glass film formed on said photoconductive layer, wherein said chalcogen glass film is a composite film comprising at least a first chalcogen glass layer being made of at least one selected from the group consisting of antimony trisulfide and arsenic trisulfide and a second chalcogen glass layer being made of at least one selected from the group consisting of antimony trisulfide, arsenic trisulfide, antimony triselenide and arsenic triselenide, said first chalcogen glass layer is formed in a lower pressure atmosphere and said second chalcogen gas layer is formed in a higher pressure atmosphere.

2. A photoelectric conversion device as claimed in claim 1, wherein said photoconductive layer is of N-type conductivity.

3. A photoelectric conversion device as claimed in claim 1, wherein said chalcogen glass film is a composite film comprising a first chalcogen glass layer formed in an atmosphere of inert gas at a pressure lower than $10^{-2}$ Torr and a second chalcogen glass layer formed on said first chalcogen glass layer in an atmosphere containing inert gas at a pressure of $1.5\times10^{-2}$ to $1.5\times10^{-1}$ Torr.

4. A photoelectric conversion device as claimed in claim 1, wherein said chalcogen glass film is formed first in an atmosphere of inert gas at a pressure lower than $10^{-2}$ Torr and then in an atmosphere containing inert gas at a pressure of $1.5\times10^{-2}$ to $1.5\times10^{-1}$ Torr, in such a manner that the conditions in formation are continuously varied.

5. A photoelectric conversion device as claimed in claim 1, wherein the chalcogen glass layer formed in an atmosphere containing inert gas at a pressure of $1.5\times10^{-2}$ to $1.5\times10^{-1}$ Torr has a thickness of 30 to 400 nm.

6. A photoelectric conversion device as claimed in claim 1, wherein the thickness of the whole chalcogen glass film is 30 to 1000 nm and the thicknes of the chalcogen glass layer formed in an atmosphere containing inert gas at a pressure of $1.5\times10^{-2}$ Torr to $1.5\times10^{-1}$ Torr is 30 to 400 nm.

7. A photoelectric conversion device as claimed in claim 1, wherein said amorphous silicon contains more than 50 atomic percent of silicon-germanium series substance and 5 to 50 atomic percent of hydrogen.

8. A photoelectric conversion device as claimed in claim 1, wherein said photoconductive layer has a resistivity higher than $10^{10}$ Ω·cm.

9. A photoelectric conversion device as claimed in claim 1, further comprising a blocking layer formed between said transparent conductive film and said photoconductive layer.

10. A photoelectric conversion device as claimed in claim 1, wherein each chalcogen glass layer has a thickness of 30–400 nm.

11. A method of producing a photoelectric conversion device, comprising:

a step of forming a transparent electrode on a transparent susbtrate;

a step of forming a film of hydrogenated amorphous silicon, on said transparent electrode; and a step of forming through vacuum evaporation a chalcogen glass film on said amorphous silicon film, said chalcogen glass film being a composite film comprising at least a first chalcogen glass layer made of at least one selected from the group consisting of antimony trisulfide and arsenic trisulfide and formed in an atmosphere of inert gas at a pressure lower than $10^{-2}$ Torr and a second chalcogen glass layer made of at least one selected from the group consisting of antimony trisulfide, arsenic trisulfide, antimony triselenide and arsenic triselenide and formed on said first chalcogen glass layer in an atmosphere of inert gas at a pressure of $1.5\times10^{-2}$ to $1.5\times10^{-1}$ Torr.

12. A method of producing a photoelectric conversion device, as claimed in claim 11, wherein said inert gas is argon or nitrogen.

* * * * *